US009079093B2

(12) United States Patent
Clement et al.

(10) Patent No.: US 9,079,093 B2
(45) **Date of Patent: *Jul. 14, 2015**

(54) SPORTS GLOVE HAVING IMPROVED WRIST STRAP AND DORSAL SPLINT SYSTEM

(75) Inventors: Ken Clement, Milton, CA (US); Craig Clement, Kingston, CA (US); John David Zikakis, Mount Albert, CA (US)

(73) Assignee: HAYABUSA FIGHTWEAR INC., Kingston, ON (CA)

( * ) Notice: Subject to any disclaimer, the term of this patent is extended or adjusted under 35 U.S.C. 154(b) by 665 days.

This patent is subject to a terminal disclaimer.

(21) Appl. No.: 13/396,578

(22) Filed: Feb. 14, 2012

(65) Prior Publication Data

US 2012/0210484 A1 Aug. 23, 2012

Related U.S. Application Data

(63) Continuation-in-part of application No. 13/031,964, filed on Feb. 22, 2011, now Pat. No. 8,646,113.

(51) Int. Cl.

| | |
|---|---|
| ***A41D 13/08*** | (2006.01) |
| ***A63B 71/14*** | (2006.01) |
| *A63B 69/00* | (2006.01) |

(52) U.S. Cl.

CPC ..... *A63B 71/145* (2013.01); *A63B 69/004* (2013.01); *A63B 2209/10* (2013.01); *A63B 2244/102* (2013.01)

(58) Field of Classification Search

CPC ..... A63B 2209/10; A63B 2244/102; A63B 69/004; A63B 71/145

USPC ..... 2/18, 161.1, 161.4, 162, 161.7, 161.8, 2/160, 161.5, 170, 159, 20; 602/21, 64

See application file for complete search history.

(56) References Cited

U.S. PATENT DOCUMENTS

| | | | | |
|---|---|---|---|---|
| 4,287,610 | A * | 9/1981 | Rhee | 2/18 |
| 4,958,384 | A * | 9/1990 | McCrane | 2/161.6 |
| 4,984,300 | A | 1/1991 | Cho | |

(Continued)

FOREIGN PATENT DOCUMENTS

WO WO 2011/006053 A1 1/2011

OTHER PUBLICATIONS

International Searching Authority, "International Search Report and Written Opinion", for application PCT/CA2011/050107, applicant Hayabusa Fightwear Inc. et al, Feb. 22, 2011.

*Primary Examiner* — Anna Kinsaul

(74) *Attorney, Agent, or Firm* — Moore & Van Allen PLLC

(57) ABSTRACT

A protective sports glove worn by athletes during training or for use in a combative event to protect against injury and increase performance (including but not limited to total force generation, grip strength, striking force and speed, muscular endurance, time to contraction, etc.). These gloves are engineered with a dorsal splint system and a cooperating adjustable dual strapping wrist tie system to secure the gloves to the contour of the hands, to ensure they remain tight and fixed, and to support the wrist from excessive bending. The dual strapping system with the dorsal splint system provides increased wrist/hand rigidity mirroring a tightness of hand wrap bandages for maximal bone and tendon support of the hands and wrists, and this novel tie system increases the transfer of force generation to the point of impact.

5 Claims, 18 Drawing Sheets

(56) References Cited

U.S. PATENT DOCUMENTS

| | | | | | |
|---|---|---|---|---|---|
| D320,872 | S | * | 10/1991 | McCrane | D29/113 |
| 5,083,314 | A | | 1/1992 | Andujar | |
| 5,146,624 | A | * | 9/1992 | Bruckner | 2/18 |
| 5,197,149 | A | * | 3/1993 | Overton | 2/162 |
| 5,295,269 | A | | 3/1994 | Ballard | |
| D362,927 | S | * | 10/1995 | McCrane | D29/117.1 |
| 5,513,391 | A | | 5/1996 | Garneau et al. | |
| 5,706,521 | A | | 1/1998 | Haney | |
| 5,802,614 | A | | 9/1998 | Melone | |
| 6,119,267 | A | | 9/2000 | Pozzi | |
| 6,178,553 | B1 | | 1/2001 | Bolton | |
| 6,553,576 | B1 | * | 4/2003 | Knapp | 2/161.6 |
| 6,604,244 | B1 | * | 8/2003 | Leach | 2/161.6 |
| 2009/0320178 | A1 | | 12/2009 | Faulconer | |

* cited by examiner

SPORTS GLOVE HAVING IMPROVED WRIST STRAP AND DORSAL SPLINT SYSTEM

RELATED APPLICATIONS

This application is a continuation-in-part of U.S. patent application Ser. No. 13/031,964 filed 22 Feb. 2011 now U.S. Pat. No. 8,646,113.

FIELD OF THE INVENTION

This invention relates to a combat sports glove designed for improved fit and function. More specifically, the invention relates to a combat sports glove having an adjustable dual system wrist support system and/or a dorsal splint system.

BACKGROUND OF THE INVENTION

Combat athletes, especially mixed martial arts (MMA) practitioners, use gloves that generally are cumbersome, thick, non form-fitting and lack in adequate wrist and hand support that quickly, with repetitive use, lose the ability to maintain proper fit and function. This can lead to a decrease in force generation and related hand and first functioning and can also lead to injury. A shortcoming of these conventional combat gloves is that when the glove strikes a target or opponent the hand can be loose and the wrist can be unstable. It can therefore be appreciated that force loss and injury can be experienced by the athlete during training and during a competitive event. Maintaining maximal force production in relation to striking force and grip strength are key factors in support performance during stand up or ground combat. Injury prevention is also of great importance to these athletes especially specific to protection related to the hands and fists. In particular, through repeated use and wear, the glove fit may become lose and inadequate to function properly.

SUMMARY OF THE INVENTION

The present invention provides a protective sports glove worn. The glove may be used by athletes during training or in a combative event requiring striking to protect against injury and increase performance, including, but not limited to, total force transference, grip strength, striking force and speed, muscular endurance, time to contraction, etc.

The present invention provides an adjustable dual strapping wrist tie system to secure the glove to the contour of the hand and ensure it remains tight and fixed. The dual strapping system seeks to provide increased wrist and hand rigidity that mirrors a tightness of hand wrap bandages for maximal bone and tendon support of the hands and wrists.

This system also advantageously increases the transfer of force to the point of impact.

Various embodiments of the present invention provide a combat sports glove having improved fit and function comprising a body having a dorsal portion, having a dorsal splint system, a volar portion, a finger portion, and a wrist portion having a dual strap closure with a primary support strap and a secondary support strap. The primary support strap first fastens around the wrist, followed by, in the opposing direction, the secondary support strap. In one embodiment—of the invention, at least one of the straps of the dual strap closure comprises a non-stretch material. In one aspect of this embodiment, the strap not having a non-stretch material comprises an elastic portion. In a preferred embodiment, the secondary support strap comprises a non-stretch material and the primary support strap comprises an elastic portion. In another embodiment, the dorsal portion comprises a splint system that includes at least two individual support elements. In another aspect, the splint system includes more than two individual support elements.

In a first aspect, the present invention provides a glove having a dual strap closure as thus described, the glove comprising: a body having: a dorsal portion having a dorsal splint system; a volar portion; a finger portion for fingers; and a wrist portion for a wrist; wherein the finger portion comprises two separate cavities, one for containing the thumb and another for containing the second, third, fourth, and fifth fingers.

In a second aspect, the present invention provides a protective sports glove comprising: a body having: a dorsal portion; a volar portion; a finger portion for fingers; and a wrist portion for a wrist; wherein the finger portion has a first section for enclosing the second, third, fourth and fifth fingers together and a second section for enclosing the thumb; wherein the dorsal portion has a layer of padding extending over a dorsal side of the first and second sections of the finger portion; wherein the wrist portion of the body has a strap closure for adjustably securing the glove to the wrist and is continuous over the dorsal portion and discontinuous over the volar portion, thereby forming a gap on the volar portion and extending distally and having a termination point prior to the finger portion, and the gap has a thumb-side edge and an opposing-side edge; wherein the strap closure has a primary support strap and a secondary support strap, and each strap has a reversible fastening means; wherein the primary support strap is fixed at the thumb-side edge of the gap and arranged to pass across the gap and through a slot on the opposing-side edge of the gap for fastening to the dorsal side of the wrist portion, the dorsal side of the wrist portion is adapted for reversible fastening; and wherein the secondary support strap is fixed at the opposing-side of the gap and arranged to pass across the gap in a direction opposite that of the support strap for fastening to the dorsal side of the wrist portion overtop the fastened support strap.

In a third aspect, the present invention provides a protective sports glove comprising: a body having: a dorsal portion; a volar portion; a finger portion for fingers; and a wrist portion for a wrist; wherein the finger portion has a section for enclosing the fingers, and the region for enclosing the fingers has loops for individually accepting the second, third, fourth, and fifth proximal phalanges; wherein the dorsal portion has a layer of padding covering at least the second, third, fourth, and fifth metacarpals and proximal phalanges and associated base knuckles; wherein the wrist portion of the body has a strap closure for adjustably securing the glove to the wrist and is continuous over the dorsal portion and discontinuous over the volar portion, thereby forming a gap on the volar portion and extending distally and having a termination point prior to the finger portion, and the gap has a thumb-side edge and an opposing-side edge; wherein the strap closure has a primary support strap and a secondary support strap, such that each strap has a reversible fastening means; wherein the primary support strap is fixed at the thumb-side edge of the gap and arranged to pass across the gap and through a slot on the opposing-side edge of the gap for fastening to the dorsal side of the wrist portion, the dorsal side of the wrist portion adapted for reversible fastening; and wherein the secondary support strap is fixed at the opposing-side of the gap and arranged to pass across the gap in a direction opposite that of the support strap for fastening to the dorsal side of the wrist portion overtop the fastened support strap.

In a fourth aspect, the present invention provides a protective sports glove for use by persons engaging in combat sports requiring striking with a closed first and open hand grabbing, the glove comprising: a body having: a dorsal portion; a volar portion; a finger portion for fingers; and a wrist portion for a wrist; wherein the finger portion comprising has a region for accepting the fingers, wherein such that the region for accepting the fingers comprises loops for individually accepting the first, second, third, fourth, and fifth proximal phalanges; wherein the dorsal portion comprising has a first layer of padding covering at least the second, third, fourth, and fifth metacarpals and proximal phalanges and associated base knuckles and a second layer of padding covering the thumb metacarpal and proximal phalange; wherein the wrist portion of the body comprising has a strap closure for adjustably securing the glove to the wrist and is continuous over the dorsal portion and discontinuous over the volar portion, thereby forming a gap on the volar portion and extending distally and having a termination point prior to the finger portion, the gap having a thumb-side edge and an opposing-side edge; wherein the strap closure comprising has a primary support strap and a secondary support strap, and each having strap has a reversible fastening means; wherein the primary support strap being is fixed at the thumb-side edge of the gap and arranged to pass across the gap and through a slot on the opposing-side edge of the gap for fastening to the dorsal side of the wrist portion, the dorsal side of the wrist portion adapted for reversible fastening; and the secondary support strap being is fixed at the opposing-side of the gap and arranged to pass across the gap in a direction opposite that of the support strap for fastening to the dorsal side of the wrist portion overtop the fastened support strap.

In a fifth aspect, the present disclosure provides a protective sports glove comprising: a body having: a dorsal portion; a volar portion; a finger portion for fingers; and a wrist portion for a wrist; wherein the finger portion has a first section for enclosing the second, third, fourth and fifth fingers together and a second section for enclosing the thumb; wherein the dorsal portion has a layer of padding extending over a dorsal side of the first and second sections of the finger portion; wherein the wrist portion of the body has a gap on the volar portion for adjustably securing the glove to accommodate the wrist, and wherein the gap extends distally along the volar portion and has a termination point prior to the finger portion, and the gap has a thumb-side edge and an opposing-side edge; wherein the wrist portion has a primary support strap and a secondary support strap; wherein the primary support strap has a fastening means on both sides and is fixed at the thumb-side edge of the gap and arranged to pass across the gap and through a slot on the opposing-side edge of the gap for fastening to the dorsal side of the wrist portion, the dorsal side of the wrist portion is adapted for fastening; wherein pulling the primary support strap through the slot acts to narrow the gap to tightly conform the wrist portion to the wrist; and wherein the secondary support strap has a fastening means on the side that attaches to the primary support strap on the dorsal side of the wrist portion and is fixed at the opposing-side edge of the gap and arranged to pass across the gap in a direction opposite that of the primary support strap when the primary support strap is fastened for fastening to the dorsal side of the wrist portion overtop of the fastened primary support strap and affixing to the fastened primary support strap.

BRIEF DESCRIPTION OF THE DRAWINGS

Embodiments of the invention have been chosen for purposes of illustration and description and are not intended to be limiting. Throughout the drawings, like elements are referred to by like numerals.

DETAILED DESCRIPTION

While the various embodiments of the present invention are herein described with specific examples, those examples are not intended to be limiting, and those of skill in the art will appreciate and recognize other embodiments and advantages of the present invention.

Referring now to the figures, in which like parts are identified by like numerals throughout all figures, a glove according to a preferred embodiment of the invention will be described in detail.

It should be noted that commonly accepted anatomical names are used throughout this document to refer to parts of the hand and corresponding parts of the gloves according to various embodiments of the present invention. The term, dorsal, refers to the back or top of the hand. The term, volar, refers to the bottom or palm-side of the hand. The thumb is understood to be considered the first finger but is most commonly referred to herein as the thumb. The remaining fingers, proceeding from the first finger, are herein referred to as the second, third, fourth, and fifth fingers.

Figure 1:
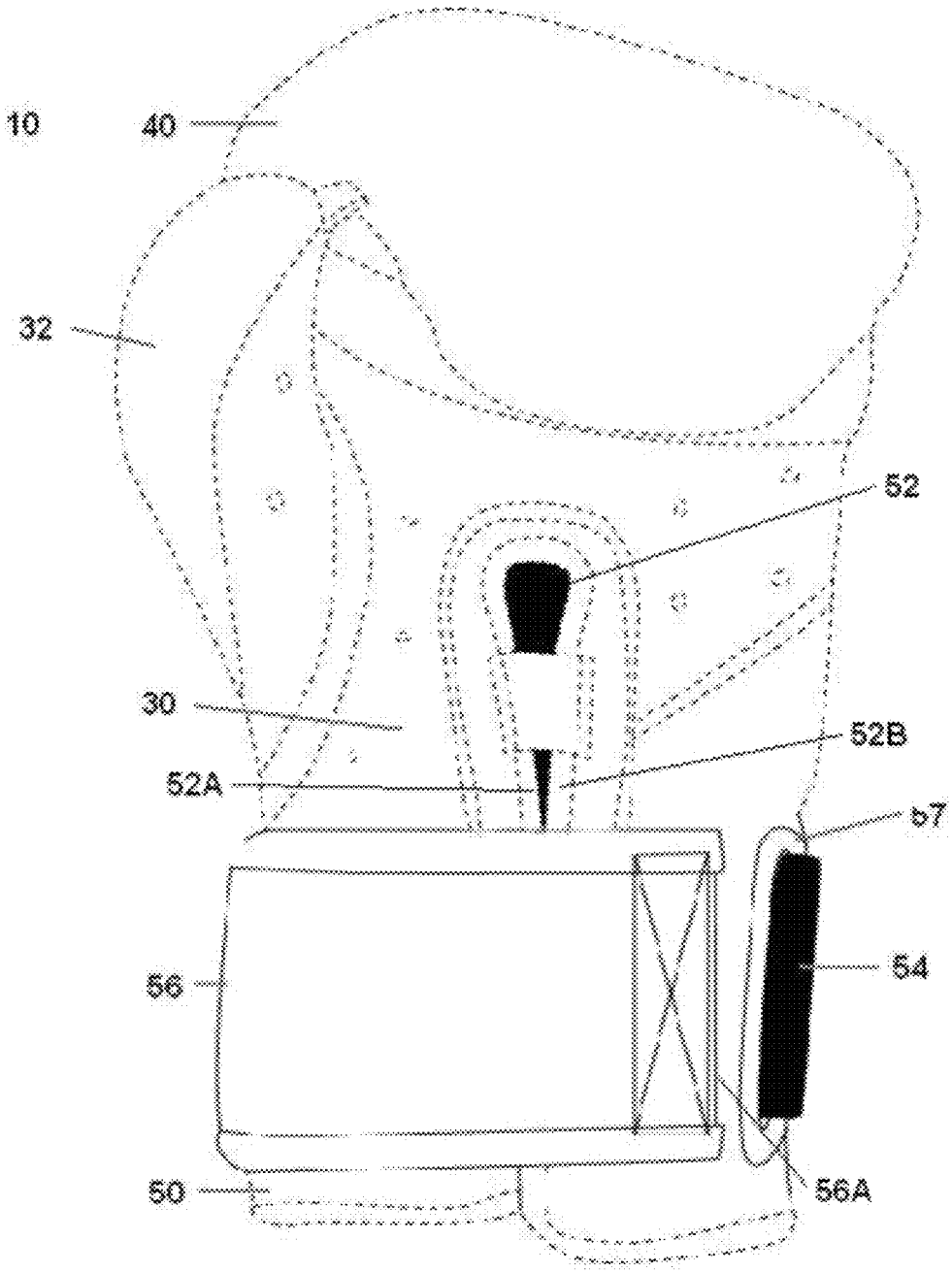
FIG. 1 is a palmer view of a glove having both straps secured in a closed configuration according to one embodiment of the present invention.

Referring to FIG. 1, a glove 10 is shown in palmer view. Glove 10 has a dorsal portion (not visible in this view) having a dorsal splint system, a volar portion 30, a thumb portion 32, a finger portion 40, and a wrist portion 50. Wrist portion 50, in the embodiment shown is formed with a gap 52, having a thumb-side edge 52A and an opposing-side edge 52B. A primary support strap 54 is attached to the thumb-side edge 52A (not visible in FIG. 1) and a secondary support strap 56 is attached to the opposing-side edge 52B at 56A. The opposing-side edge 52B contains a slot 57 through which primary support strap 54 passes through.

Figure 2:
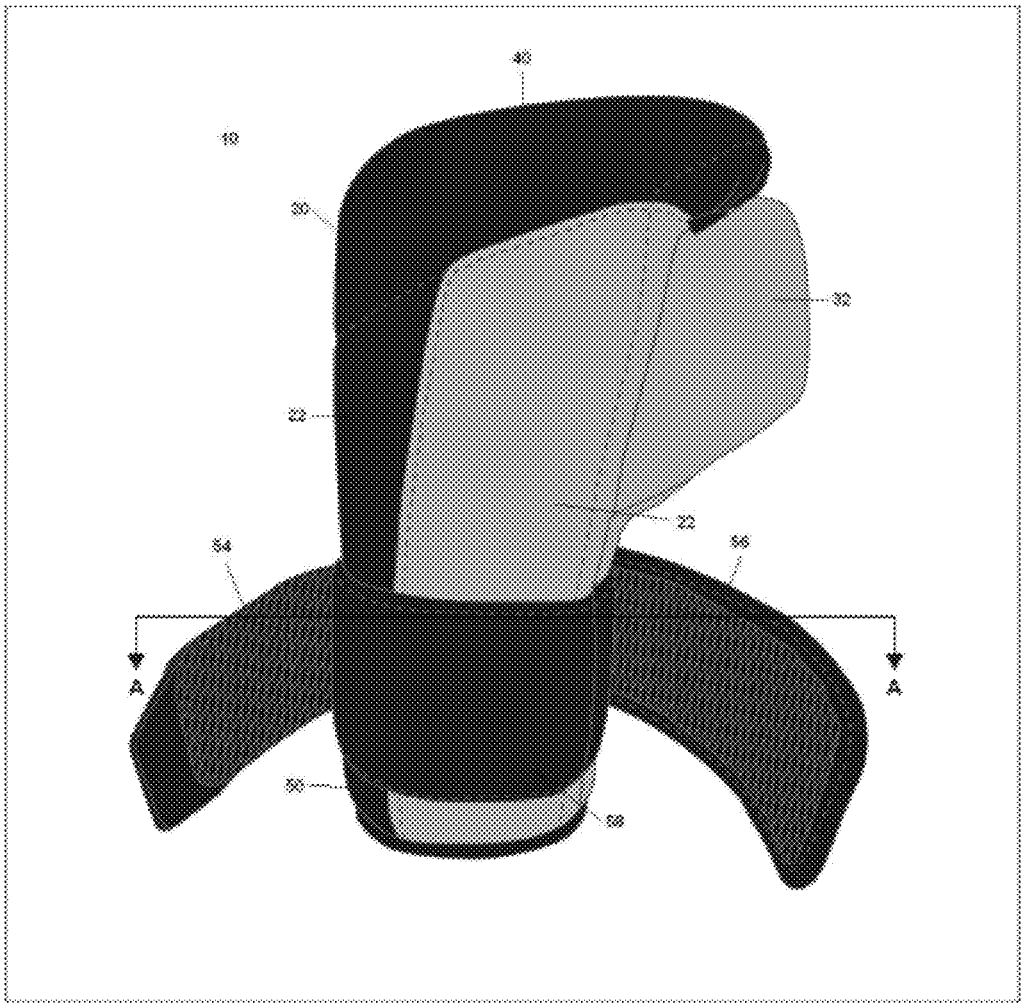
FIG. 2 is a dorsal view of the glove shown in FIG. 1 having both straps in an unsecured or unfastened opened position according to another embodiment of the present invention.

In use, an individual places their hand inside glove 10. When the primary support strap 54 and the secondary support strap 56 are unsecured, the gap 52 allows for the wrist portion 50 and the volar portion 30 to open and accommodate the hand, the hand being larger in circumference in some regions than the wrist. The individual's thumb passes into the thumb portion 32 and their second, third, fourth, and fifth fingers pass into finger portion 40. Primary support strap 54 is passed through the slot 57 as shown in FIG. 1. FIG. 2 shows the opposite side (dorsal) of the glove 10 shown in FIG. 1 with the primary support strap 54 passed through the slot 57 (not shown) and also showing dorsal portion 20 having both straps in the open position. As shown in the drawings, the dorsal portion 20 contains two individual support elements 22, together forming a dorsal splint system that extend from the finger portion 40 down to the wrist portion 50 such that the support straps overlay a portion of the support elements 22. Primary strap 54 is pulled tightly in the direction of the block arrow shown in FIG. 3. In one aspect of the preferred embodiment, the primary support strap 54 has an elastic portion, preferably near the thumb-side attachment 54A (not shown in FIG. 3). As the primary support strap 54 is pulled, it narrows or closes the gap 52 tightly conform to the wearer's hand and wrist, thereby producing a tight, supportive fit. The dorsal side of wrist portion 50 may include a region 58 having means to accommodate reversible fastening of the strap closure system, in particular the primary support strap 54, which in turn also contains a means to facilitate reversible fastening (of the secondary support strap 56). The means to facilitate reversible fastening are preferably hook-and-loop type fastening, such as Velcro®.

Figure 4:
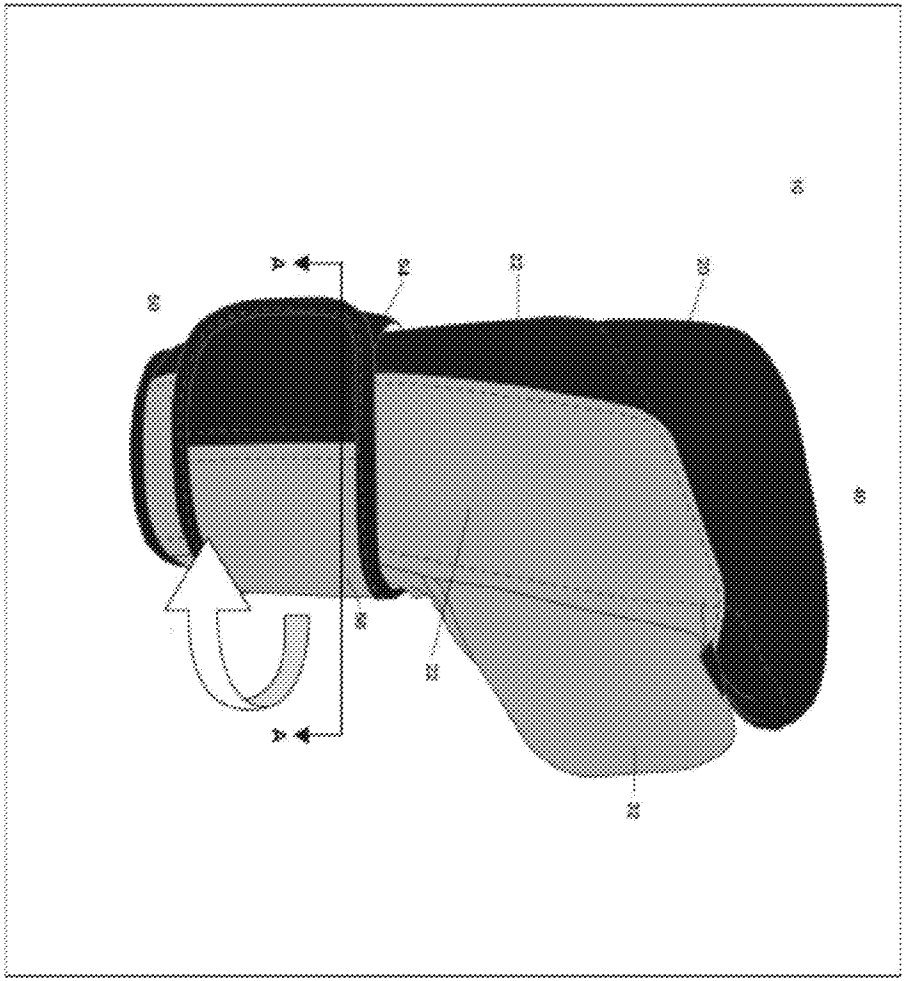
FIG. 4 is a view similar to the glove shown in FIGS. 2 and 3 showing both straps in a secured or fastened position according to another embodiment of the present invention.

Next, now referring to FIG. 4, the secondary support strap 56 is pulled tightly in the direction of the block arrow shown back in the opposite direction relative the primary strap, across over the dorsal side of wrist portion 50 and securely fastened to over the primary support strap 54 at region 58 (not shown in FIG. 4).

Figure 3:
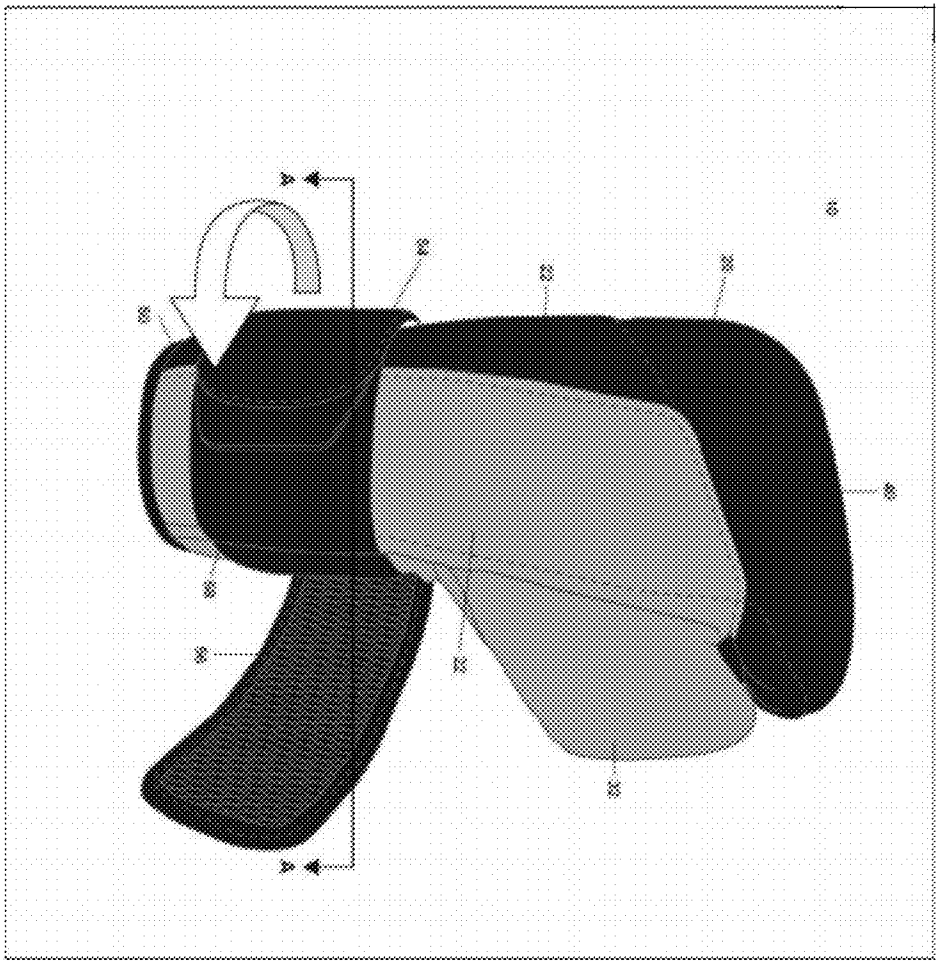
FIG. 3 is a view similar to that shown in FIG. 2 with the glove having the primary strap in a secured or fastened position according to another embodiment of the present invention.
Figure 5:
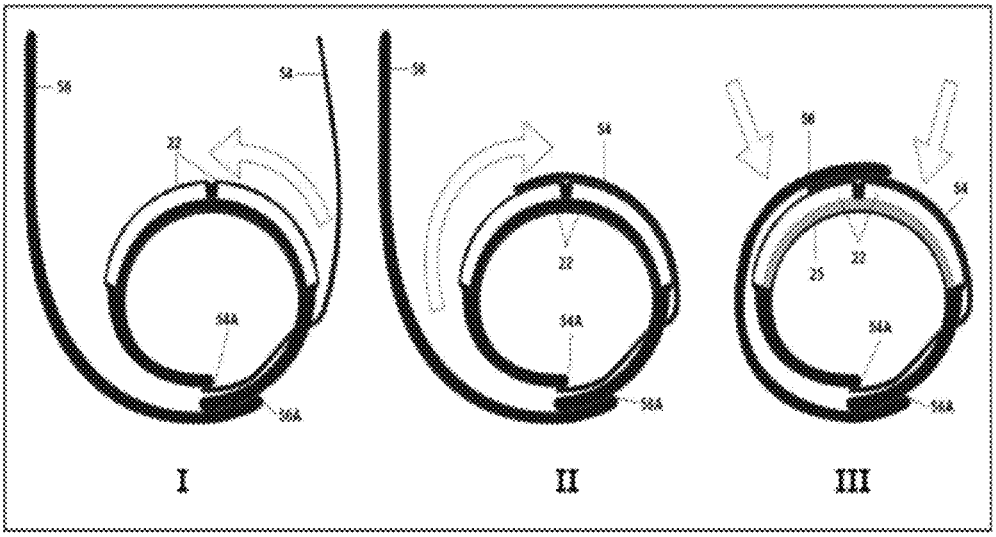
FIG. 5 is a cross-section sequence view along line A-A of FIGS. 2 through 4 showing the sequence of securing the primary and secondary straps according to another embodiment of the present invention.

Referring now to FIG. 5, a sequence of cross-sections (I, II, and III) of the glove 10 are taken from configurations shown in FIGS. 2, 3, and 4 along line A-A through the wrist portion 50 showing the region where the primary support strap 54 and secondary support strap 56 overlap a portion of the two individual support elements 22 forming the dorsal splint system. The block arrows of FIG. 5 I, II, and III correspond to the block arrows of FIGS. 2, 3, and 4, respectively, and show the direction of strap movement. To facilitate reversible fastening, secondary support strap 56 has means to facilitate fastening. To secure secondary support strap 56, it is, from the unsecured position (shown in FIGS. 2, 5I, and 5II), first pulled tightly in the direction of the block arrow shown across the volar side of wrist portion 50, then around to the dorsal side of wrist portion 50 and then across the dorsal side of wrist portion 50 and fastened overtop the secured primary support strap 54—the primary support strap 54 already being secured to region 58. In one aspect, the primary support strap 54 has reversible fastening means on both sides to facilitate fastening to region 58 and to facilitate fastening of the secondary support strap 56. In another aspect, the secondary support strap 56 contains at least a portion of a non-stretch material. Preferably, the non-stretch material is nylon. Most preferably, the non-stretch nylon is 420D nylon. Thus, the glove 10, in a secured and/or closed configuration as shown in FIGS. 1, 4, and 5III, provides wrist support through the interaction of the dorsal splint system, and the individual support elements 22, thereof, interacting with the primary 54 and the secondary 56 support straps, which when secured at wrist portion 50, function as a single reinforcing structure 25 shown in FIG. 5III.

Gloves in accordance with the present invention provide improved wrist closure and support for improved fit and function by providing a dual cross directional strap system for use in conjunction with a dorsal splint system to provide protection for the back of the hand and the wrist. It has been found that gloves not made in accordance with the various embodiments of the invention would become loose due to stretching of the wrist closure within about 2 months of regular use. Advantageously, gloves in accordance with the various embodiments of the present invention seek to avoid this rapid loosening and maintain proper fit and function for longer time.

Figure 6:
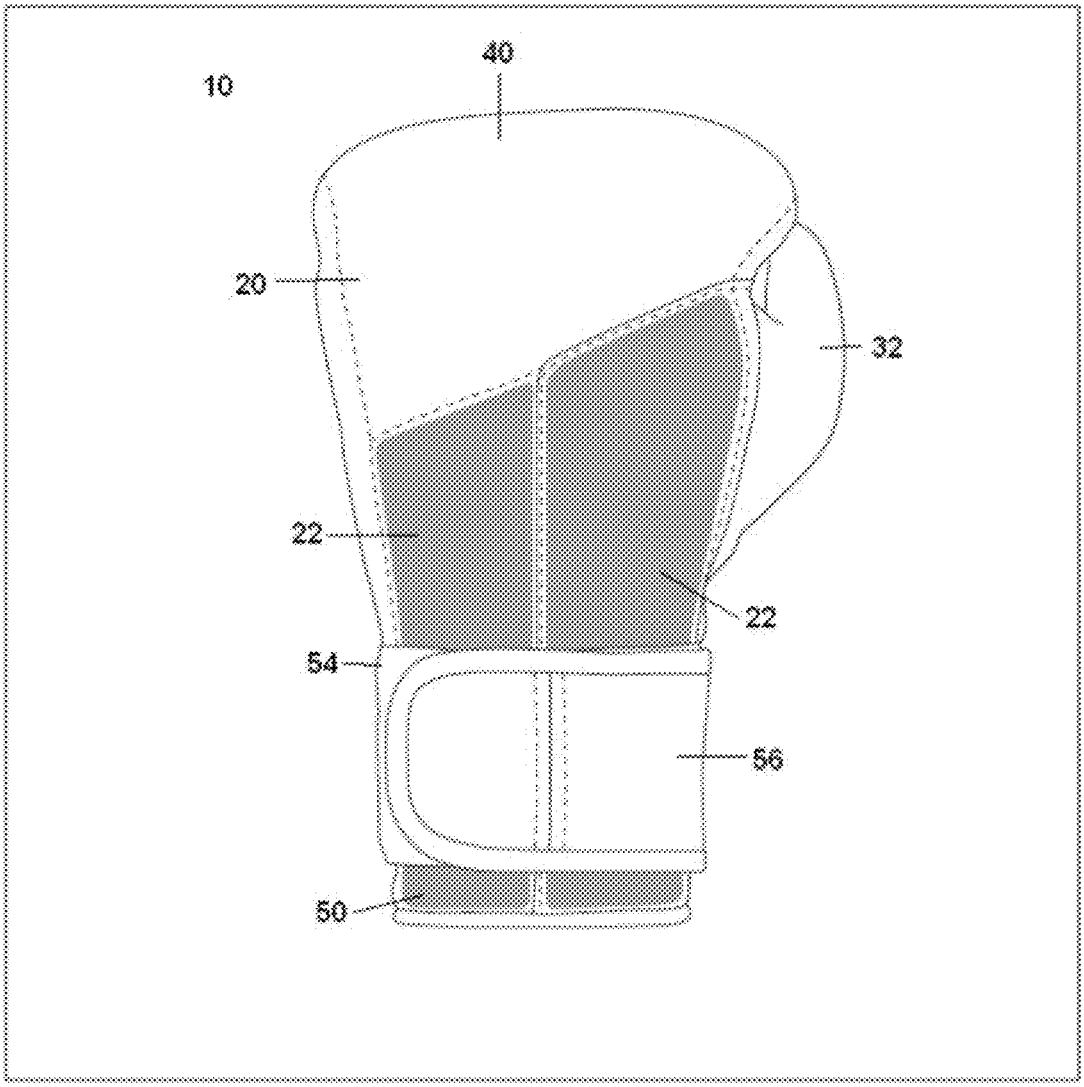
FIG. 6 is a dorsal view of the glove showing the dorsal splint system according to another embodiment of the present invention.

Referring now to FIG. 6, the dorsal splint system, according to one aspect of the present invention, is comprised of multiple sections of support material 22 incorporated into the dorsal side of the glove. The dual strap closure system secures over the region of the dorsal splint system support material distal relative to the fingers. The dorsal splint system comprises multiple separate sections, preferably two. The gloves according to this embodiment limit movement of the wrist and are therefore intended to be used primarily for striking activities. When the glove is not being worn and the dual strap system is loosened, the multiple sections of the dorsal splint system are free to move and bend relative to one another, and the multiple sections allow the gloves to be easily applied to the hand of the wearer and allow wrist movement. Once the dual strap system is secured, the straps encircle a portion of each of the dorsal splint support sections over the wrist of the wearer, thereby causing the multiple sections to engage and support one-another, thereby providing support for the wrist and protection for the back of the hand—this support and protection is greater than what would result from a single dorsal support section.

Figure 7:
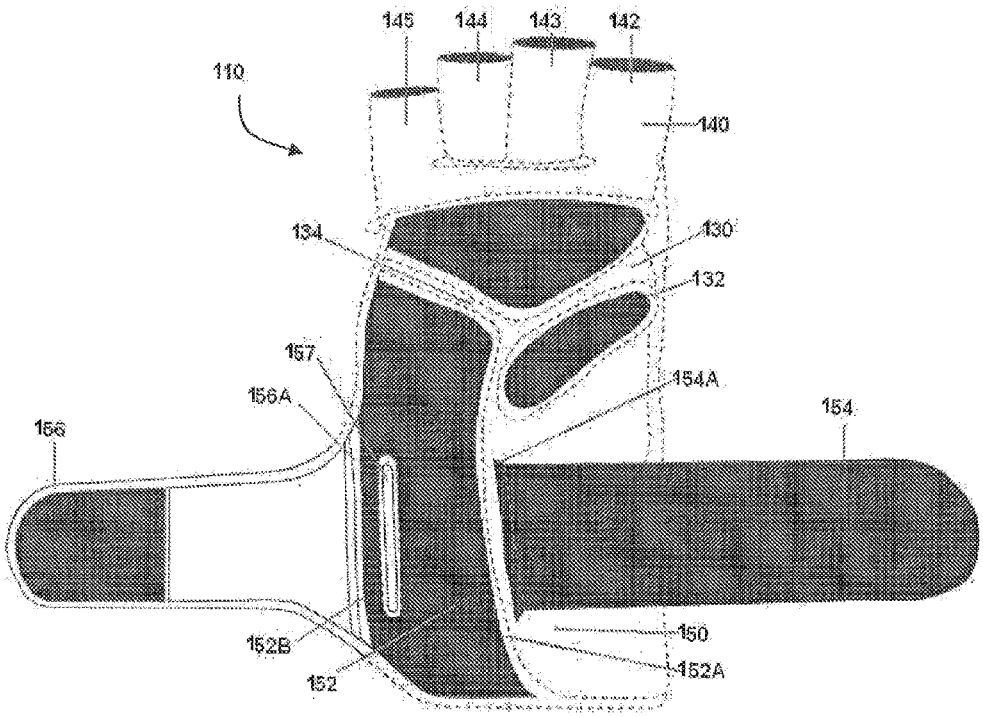
FIG. 7 is a bottom view showing the volar/palm side of a glove showing both straps open according to one embodiment of the present invention.

FIG. 7 shows a glove 110 in palmer view according to another embodiment of the present invention. Glove 110 has a dorsal portion (not visible in this view), a volar portion 130, a finger portion 140, and a wrist portion 150. The volar portion 130 contains an elongated thumb slot 132 for allowing thumb movement. Volar portion 130, in combination with the elongated thumb slot 132, forms, in a preferred embodiment, a Y-shaped structure 134.

According to a preferred embodiment, the finger portion 140 is comprised of loops for individually accepting the second 142, third 143, fourth 144, and fifth 145 proximal phalanges. Wrist portion 150 is formed with a gap 152, having a thumb-side edge 152A and an opposing-side edge 152B. A primary support strap 154 is attached to the thumb-side edge 152A at 154A and a secondary support strap 156 is attached to the opposing-side edge 152B at 156A. The opposing-side edge 152B contains a slot 157.

In use, an individual places their hand inside glove 110. The gap 152 allows for the wrist portion 150 and volar portion 130 to open and accommodate the hand, the hand being larger in circumference in some regions than the wrist. The individual's thumb passes through thumb slot 132 and their second, third, fourth, and fifth fingers pass through loops 142, 143, 144, and 145, respectively, of finger portion 140.

Figure 8:
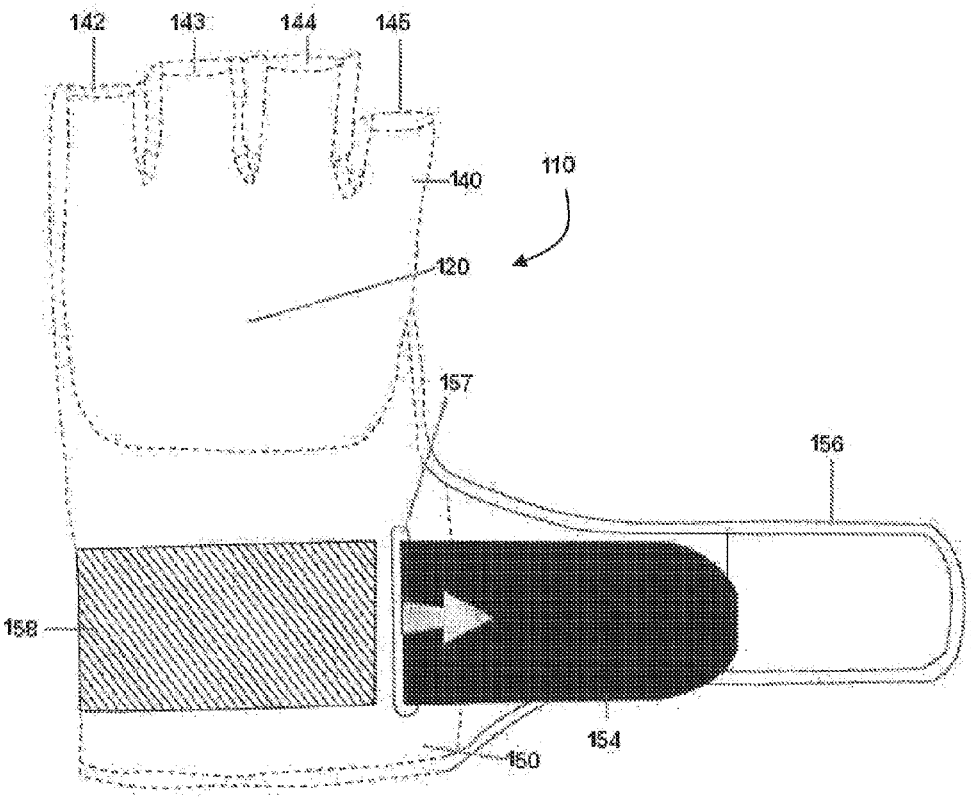
FIG. 8 is a top view of the dorsal/top side of the glove shown in FIG. 7 having the primary strap passed through the slot and in an unsecured or unfastened position.

Next, primary support strap 154 is passed through slot 157 as shown in FIG. 8. FIG. 8 shows the opposite side of the glove 110 shown in FIG. 7 with the primary support strap 154 passed through slot 157 and also showing dorsal portion 120. In some embodiments, dorsal portion 120 contains padding material to protect the dorsal part of the hand and the proximal phalanges portions of the second, third, fourth, and fifth fingers. In use, primary strap 154 is pulled tightly in the direction of the straight arrow shown in FIG. 8. In a preferred embodiment, the primary support strap 154 has an elastic portion, preferably near the thumb-side attachment 154A. As primary support strap 154 is pulled, it narrows or closes the gap 152 and volar Y-shaped structure 134 to tightly conform to the wearer's hand and wrist, thereby producing a tight, supportive fit. The dorsal side of wrist portion 150 includes a region 158 having means to accommodate removable fastening of the strap closure system (shown in crosshatch), in particular the primary support strap 154, which in turn also contains a means to facilitate removable fastening. The means to facilitate removable fastening are preferably hook-and-loop type fastening, such as that made by Velcro®.

Figure 9:
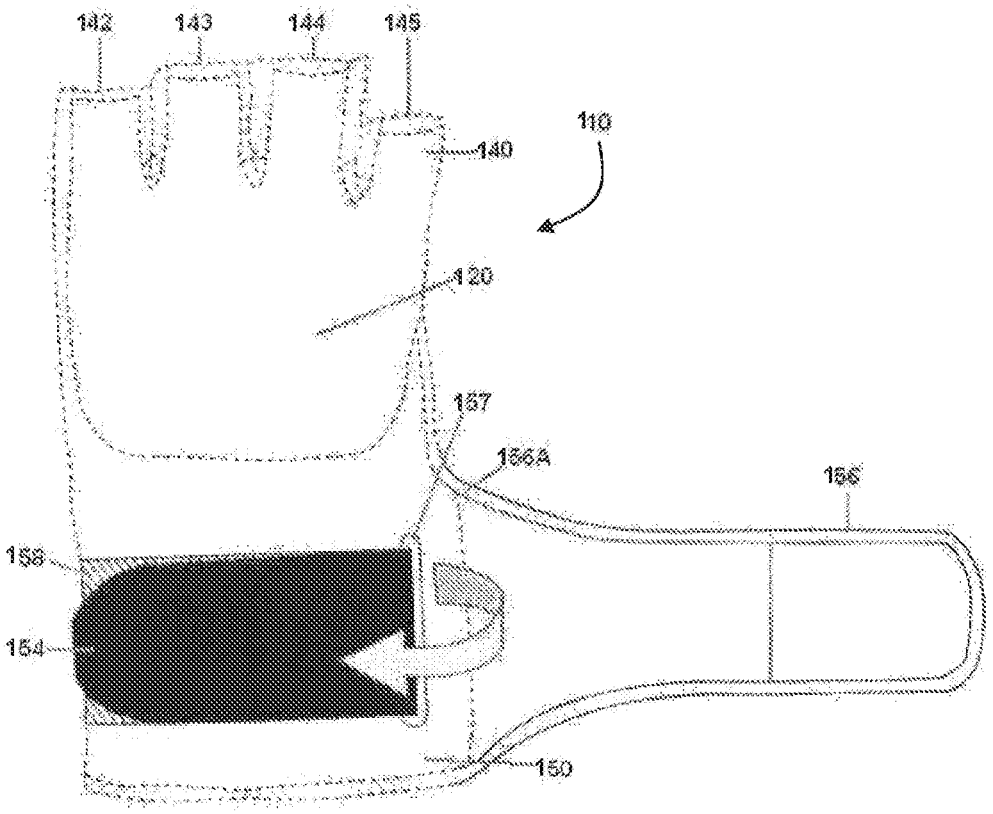
FIG. 9 is a view similar to that shown in FIG. 8 with the glove having the primary strap passed through the slot and in a secured or fastened position.

Now referring to FIG. 9, the primary support strap 154, having been pulled tightly as shown in FIG. 8 is now shown in a fastened position having been pulled in the direction of the straight arrow shown in FIG. 9. The primary support strap 154 is pulled back across over the dorsal side of wrist portion 150 in the opposite direction against slot 157 and securely fastened to region 158.

Figure 10:
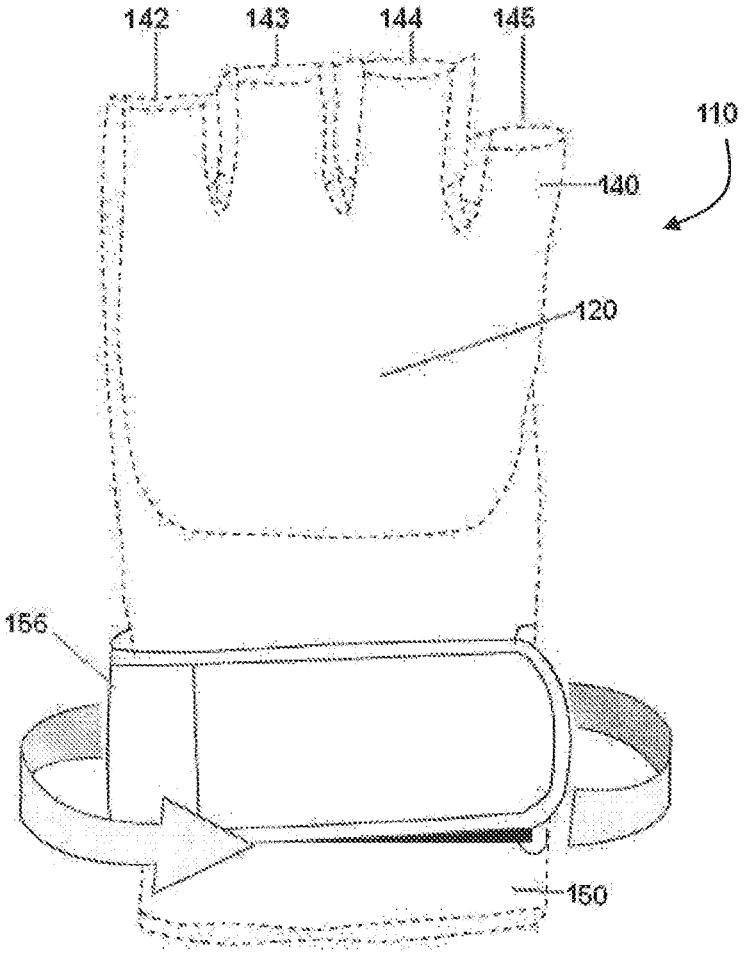
FIG. 10 is a top view of the dorsal side of the glove shown in FIG. 9 showing both straps in a secured or fastened position.

Referring now to FIG. 10, glove 110 is shown in a dorsal view with the dual strap closure system fully closed and secured. To facilitate removable fastening, the secondary support strap 156 has means to facilitate fastening to the primary support strap on the dorsal side of the wrist portion. To secure secondary support strap 156, it is, from the unsecured position (shown in FIGS. 7 through 9), first pulled tightly in the direction of the arrow shown in FIG. 10 across the volar side of wrist portion 150 (shown in FIG. 7), then around to the dorsal side of wrist portion 150 and then across the dorsal side of wrist portion 150 and fastened overtop of the secured primary support strap 154, which is already secured to region 158.

In an alternate embodiment, the primary support strap 154 has removable fastening means on both of its sides to facilitate fastening to region 158 and to facilitate fastening of the secondary support strap 156. In further aspects of the preferred embodiment, secondary support strap 156 includes at least a portion of a non-stretch material.

Figure 11:
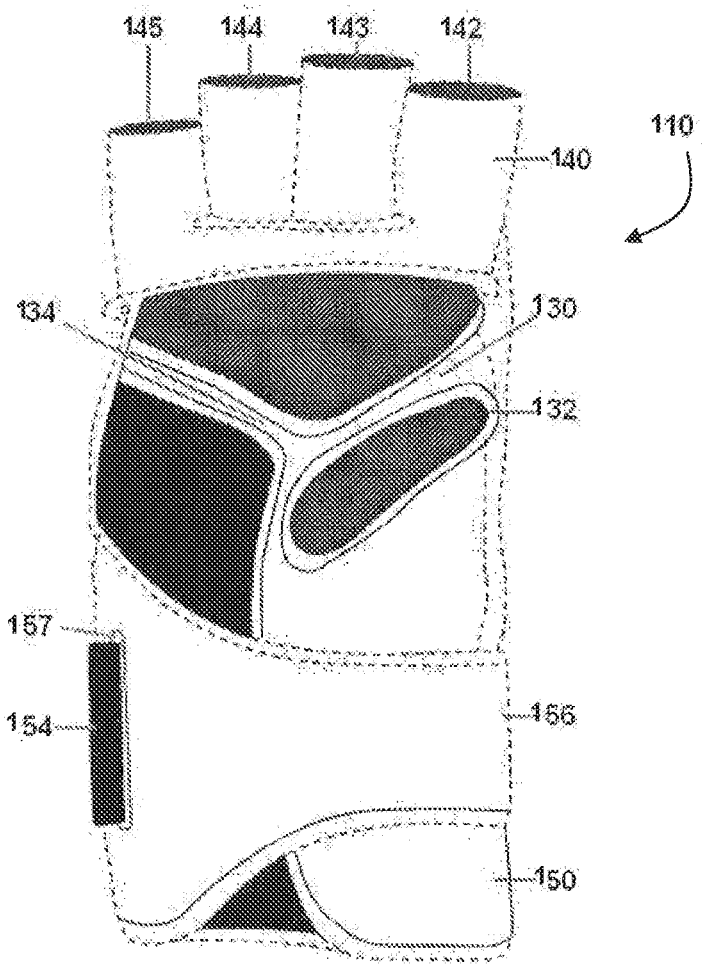
FIG. 11 is a bottom view of the volar side of the glove shown in FIG. 10.

FIG. 11 shows the volar-side view of the glove with the straps fastened.

FIGS. 12 through 16 show the glove 110 in an alternate embodiment but with a corresponding operation of the dual strap system as shown in FIGS. 7 through 11.

Figure 12:
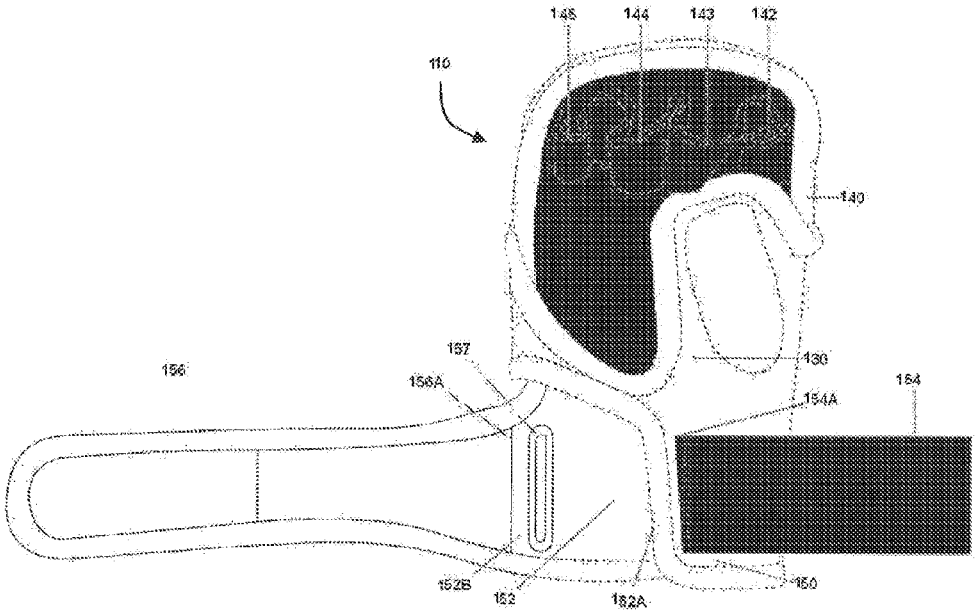
FIG. 12 is a bottom view showing the volar/palm side of a glove according to a fourth embodiment of the present invention showing both straps open.
Figure 13:
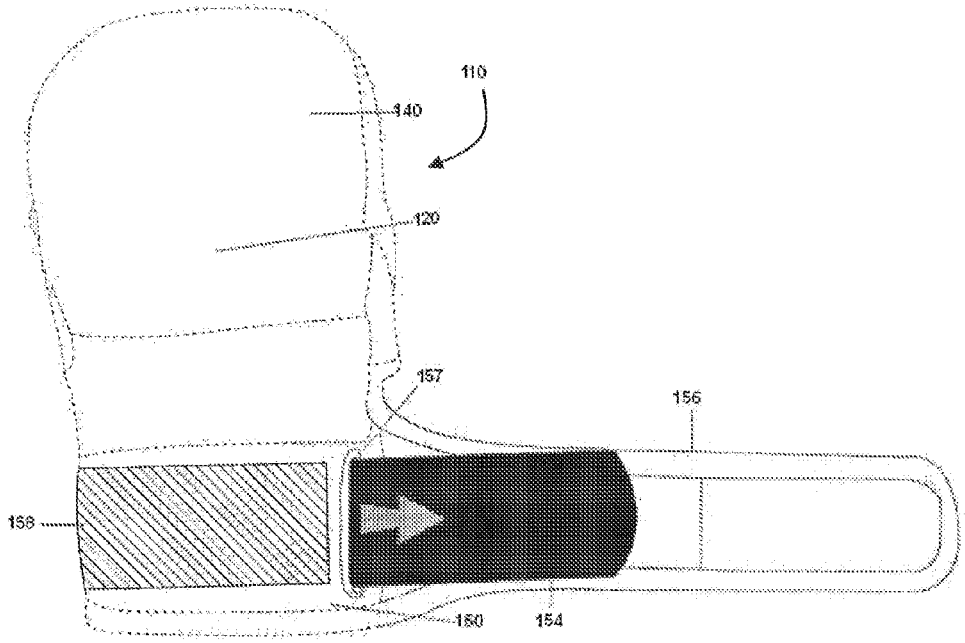
FIG. 13 is a top view of the dorsal/top side of the glove shown in FIG. 12 having the primary strap passed through the slot and in an unsecured or unfastened position.
Figure 14:
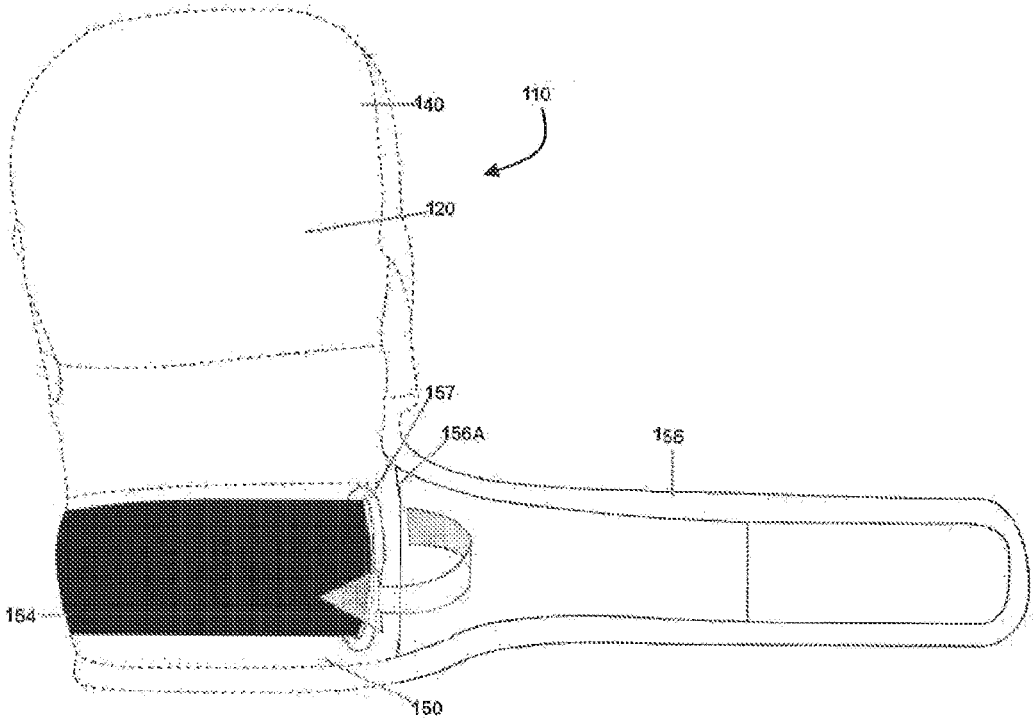
FIG. 14 is a view similar to that shown in FIG. 13 with the glove having the primary strap passed through the slot and in a secured or fastened position.

Referring now to FIG. 12, a glove 110 is shown in palmer view. Glove 110 has a dorsal portion (not visible in this view), a volar portion 130, a finger portion 140, and a wrist portion 150. The finger portion 140 according to this embodiment is comprised of loops for individually accepting the thumb (not visible in the figures), second 142, third 143, fourth 144, and fifth 145 proximal phalanges. Wrist portion 150 is formed with a gap 152, having a thumb-side edge 152A and an opposing-side edge 152B. A primary support strap 154 is attached to the thumb-side edge 152A at 154A and a secondary support strap 156 is attached to the opposing-side edge 152B at 56A. The opposing-side edge 152B contains a slot 157.

For the use of the dual strap system, FIGS. 13 through 16 correspond to FIGS. 8 through 11, respectively. Like parts are identified by the same numerals.

Figure 15:
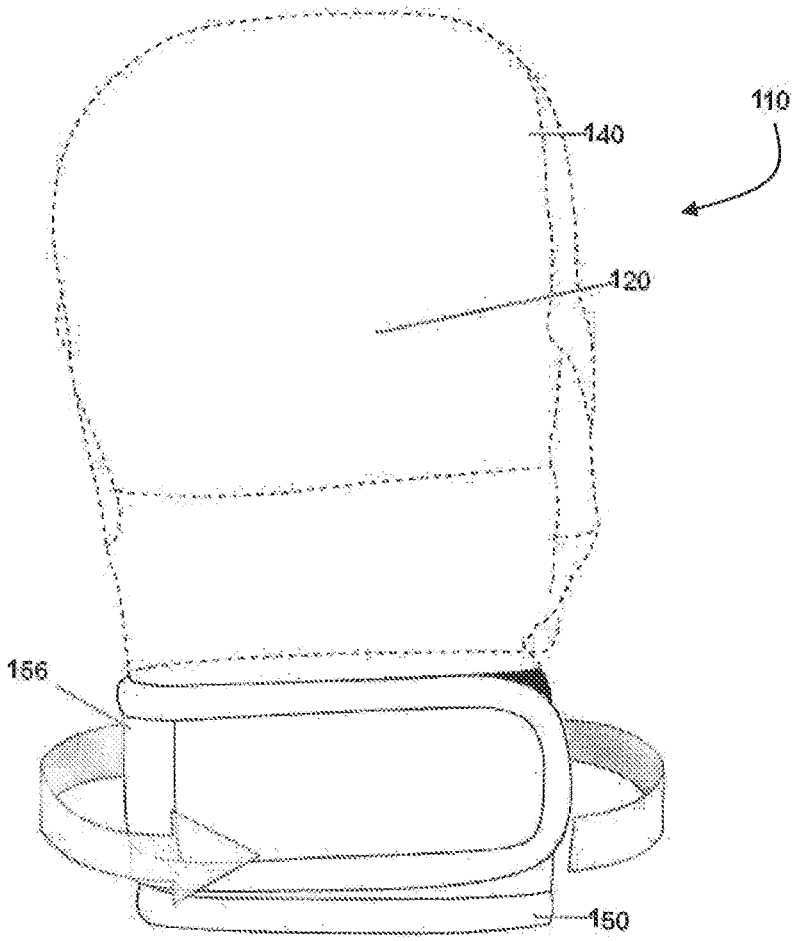
FIG. 15 is a top view of the dorsal side of the glove shown in FIG. 14 showing both straps in a secured or fastened position.
Figure 16:
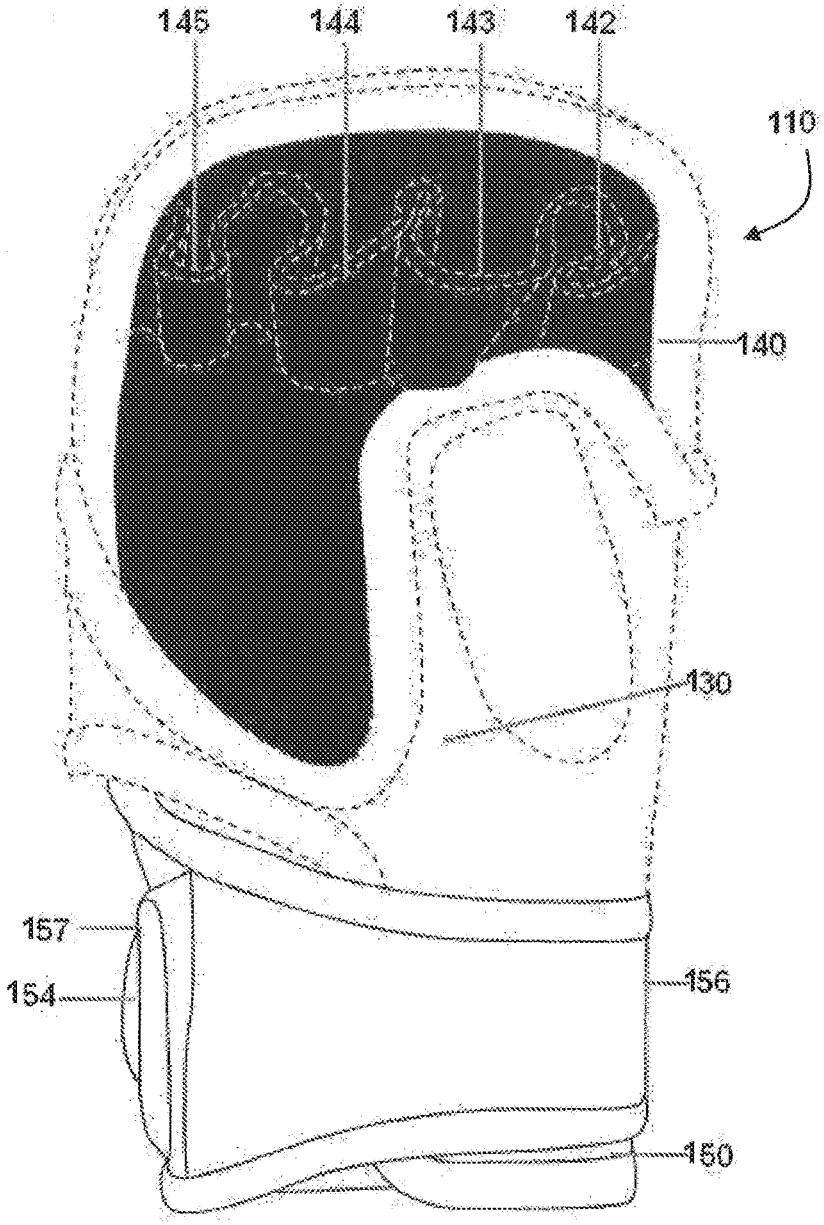
FIG. 16 is a bottom view of the volar side of the glove shown in FIG. 15.
Figure 17:
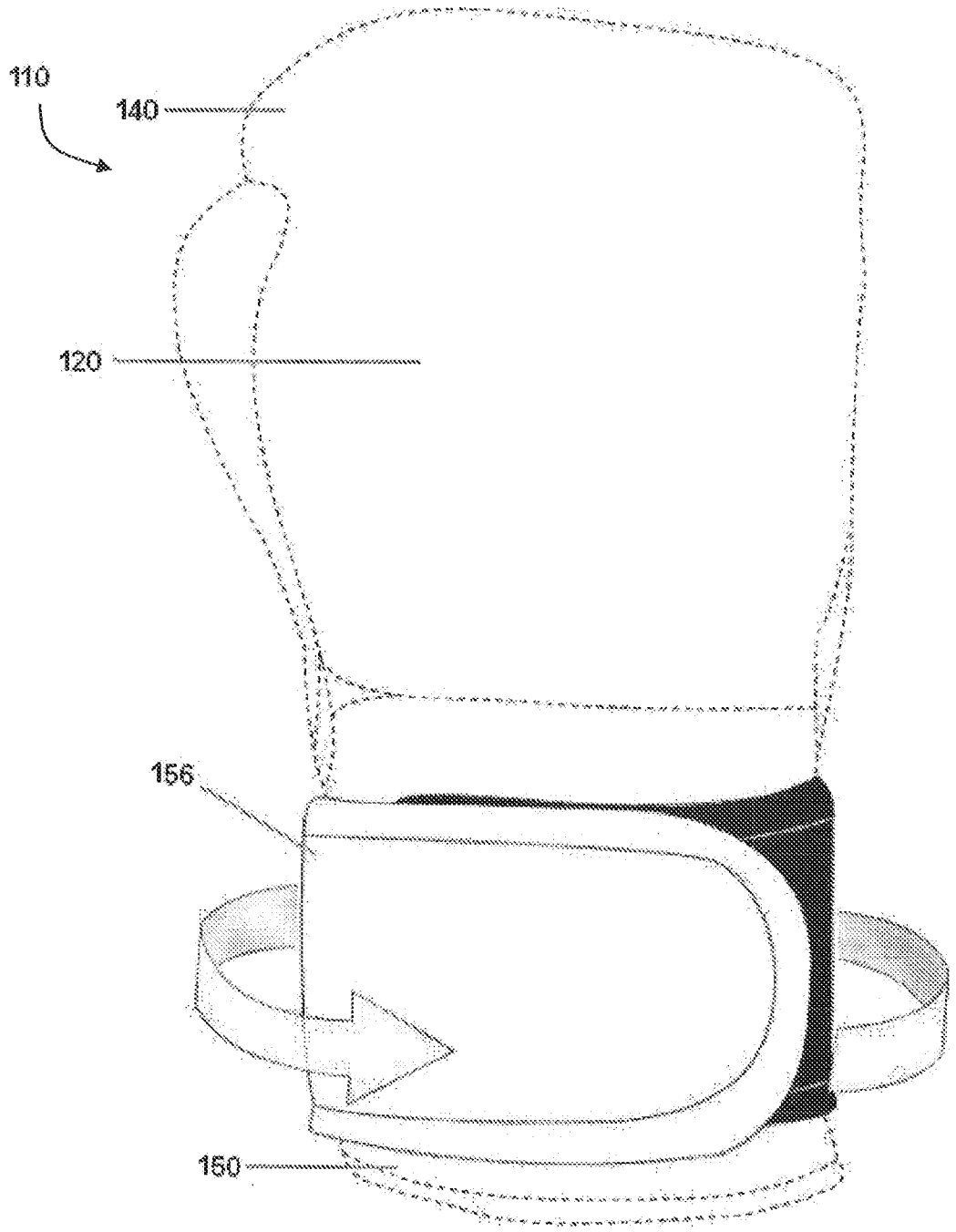
FIG. 17 is a top view of the dorsal/top side of a glove showing both straps in a secured or fastened position according to another alternative embodiment of the present invention.
Figure 18:
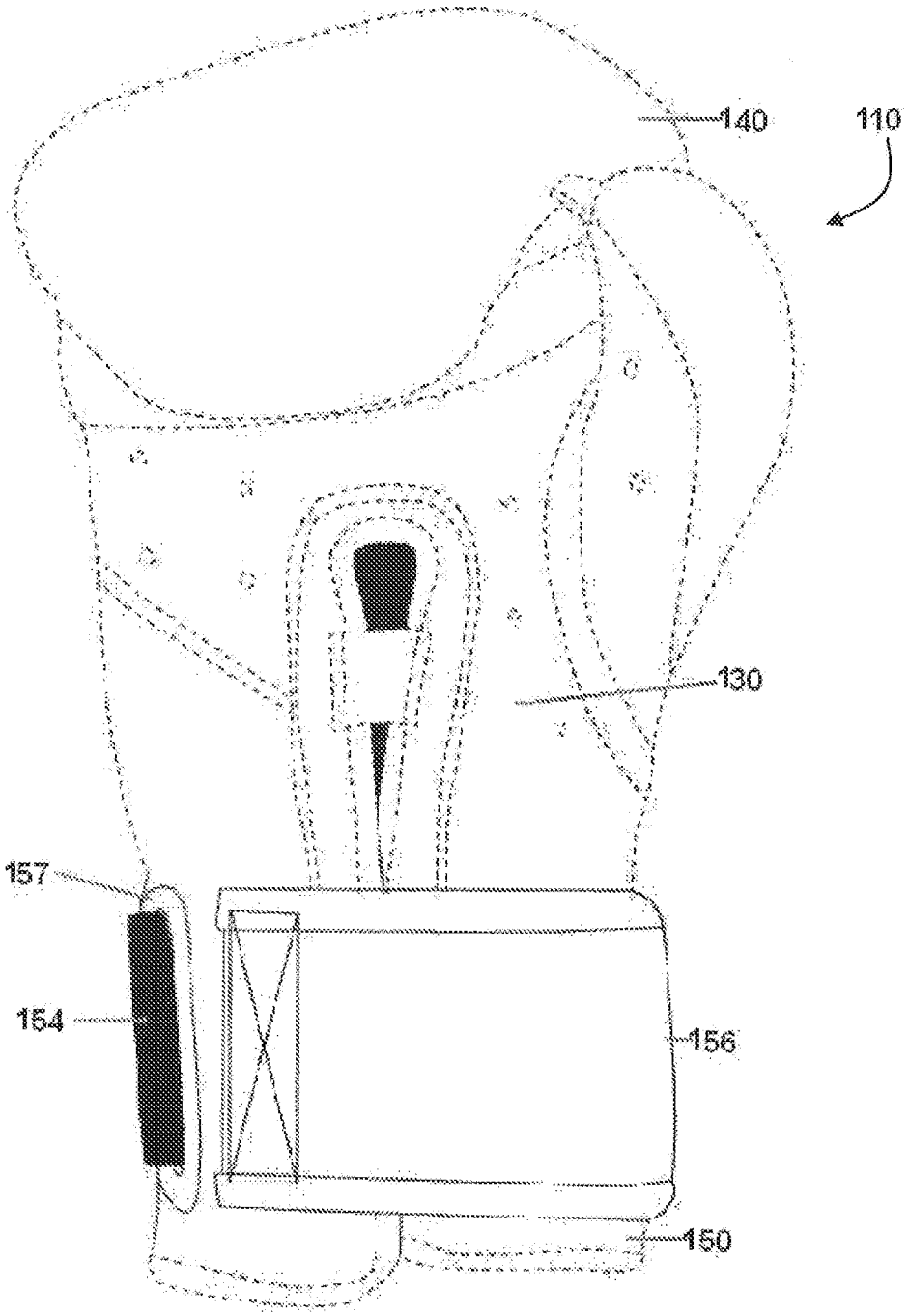
FIG. 18 is a bottom view of the volar side of the glove shown in FIG. 17.

FIGS. 17 and 18 show a glove according to another alternate embodiment of the present invention and correspond to FIGS. 10 and 11 and to FIGS. 15 and 16. Closure of the dual strap system is as previously described. Glove 110 has a dorsal portion 120, a volar portion 130, a finger portion 140, and a wrist portion 150. Finger portion 140 is comprised of two separate compartments; one for receiving the thumb and one for receiving the second, third, fourth, and fifth fingers. FIG. 17 shows the glove 110 in dorsal view with the primary support strap 154 (not shown) already fastened as described in the embodiments above and the secondary support strap 156 being fastened as in FIGS. 10 and 15. FIG. 18 shows glove 110 in palmer view with both straps secured as in FIGS. 11 and 16.

The present invention provides gloves with improved wrist closure for improved fit and function by providing a dual cross directional strap system with the combination of a primary support strap having an elastic, stretchable portion and a non-stretchable secondary support strap. Advantageously, gloves in accordance with the various embodiments of the present invention prevent rapid loosening and maintain proper fit and function for longer periods of time than those of the prior art.

Further improvements in fit and function are provided, in certain embodiments of the invention, by inclusion of a volar Y-shaped structure. Here, the glove includes a contouring hand/fist Y-shaped structure to generate a bare-knuckle like contour glove to support maximal force production during striking, while providing a proper fit during open-hand grabbing and repeated transitions between opened and closed hand. This Y-shaped structure is particularly well-suited to mixed martial arts gloves.

The gloves according to various embodiments may be constructed of material commonly used to manufacture combat sport gloves. Such materials include leather, cotton, vinyl, polyester, and combinations of different materials. Synthetic leather such as polyurethane may be used. Materials such as, acrylic and poly vinyl chloride, and microfiber, cellulose, including rayon, modal, lyocell, polyamide nylon, petroleum (PET) or polybutylene Terephthalate (PBT) polyester, phenol-formaldehyde (PF), polyvinyl alcohol fiber (PVOH), polyvinyl chloride fiber (PVC), polyolefins (PP and PE), or acrylic polymers, acrylic fiber, carbon fibers and PF fibers, aromatic nylons, such as Kevlar™ and Nomex™ Fibers that have strong bonding between polymer chains (e.g., aramids), or extremely long chains (e.g., Dyneema™ or Spectra™). Elastomers may also be used, e.g., spandex. The padding, including the pads of the dorsal splint system may be constructed of commonly known material such as nylon, cotton, foam, rubber, plastic, silicone, polyurethane, polyethylene, polyborosiloxine, ethylvinylacetate and polyvinylchloride. The padding may also be constructed as composites or layers of different materials. The specific material and thickness will depend on the amount of impact protection and the desired rigidity to resist unwanted bending of the wrist.

The specific features herein described may be used in a variety of specific glove types. For example, the features may be incorporated into gloves commonly worn in specific combat sports such as boxing, kick-boxing, and mixed martial arts, which each may use gloves of different weight, including, but not limited to, 4 oz, 6 oz, 8 oz, 10 oz, 12 oz, 14 oz, 16 oz, 18 oz, and 20 oz but are best-suited to 10 oz, 12 oz, 14 oz, 16 oz, and 18 oz gloves.

We claim:

1. A protective sports glove comprising:

a body having:

a finger portion for fingers having a dorsal side and a volar side;

a wrist portion for a wrist having a dorsal side and a volar side;

wherein the finger portion has a first section for covering second, third, fourth and fifth fingers together;

wherein the volar side of the wrist portion has a gap for adjustably securing the glove to accommodate the wrist, and wherein the gap has a thumb-side edge and an opposing-side edge, wherein the gap terminates in a vertical direction prior to the finger portion;

wherein the wrist portion comprises a primary support strap, a secondary support strap, and a primary support strap slot;

wherein the primary support strap is attached to the volar side of the wrist portion on a first side of the gap, wherein the primary support strap slot is located on an opposite side of the gap relative to the primary support strap, and wherein the primary support strap is adapted for fastening to the dorsal side of the wrist portion and the primary support strap is constructed and arranged to pass across the gap and through the primary support slot to the dorsal side of the wrist portion for fastening the primary support strap to a complementary fastening on the dorsal side of the wrist portion;

wherein the primary support strap is constructed and arranged to be pulled through the primary support slot to narrow the gap and to tightly conform the wrist portion to the wrist;

wherein the secondary support strap is constructed and arranged to pass across the gap in a direction opposite that of the primary support strap but overlapping at least a portion of the primary support strap on the volar side of the wrist portion;

and wherein the secondary support strap has a fastening means that attaches to a fastened primary support strap, and the secondary support strap is constructed and arranged to fasten to complementary fastening means on top of the fastened primary support strap on the dorsal side of the wrist portion.

2. The protective sports glove of claim 1, wherein at least one of the primary support strap and the secondary support strap includes a non-stretch material.

3. The protective sports glove of claim 2, wherein the secondary support strap includes a non-stretch material.

4. The protective sports glove of claim 3, wherein the primary support strap includes an elastic portion.

5. A protective sports glove comprising:

a body having:

a finger portion for fingers having a dorsal side and a volar side;

a wrist portion for a wrist having a dorsal side and a volar side;

wherein the finger portion has a first section for the second, third, fourth and fifth fingers;

wherein the volar side of the wrist portion has a gap for adjustably securing the glove to accommodate the wrist, and wherein the gap has a thumb-side edge and an opposing-side edge, wherein the gap terminates in a vertical direction prior to the finger portion;

wherein the wrist portion comprises a primary support strap, a secondary support strap, and a primary support strap slot;

wherein the primary support strap is attached to the volar side of the wrist portion on a first side of the gap, wherein the primary support strap slot is located on an opposite side of the gap relative to the primary support strap, and wherein the primary support strap is adapted for fastening to the dorsal side of the wrist portion and the primary support strap is constructed and arranged to pass across the gap and through the primary support slot to the dorsal side of the wrist portion for fastening the primary support strap to a complementary fastening on the dorsal side of the wrist portion;

wherein the primary support strap is constructed and arranged to be pulled through the primary support slot to narrow the gap and to tightly conform the wrist portion to the wrist;

wherein the secondary support strap is constructed and arranged to pass across the gap in a direction opposite that of the primary support strap but overlapping at least a portion of the primary support strap on the volar side of the wrist portion; and wherein the primary and secondary support straps each have fastening means that attach to complementary fastening on the dorsal side of the wrist portion.

* * * * *

UNITED STATES PATENT AND TRADEMARK OFFICE

CERTIFICATE OF CORRECTION

PATENT NO. : 9,079,093 B2
APPLICATION NO. : 13/396578
DATED : July 14, 2015
INVENTOR(S) : Ken Clement, Craig Clement and John David Zikakis It is certified that error appears in the above-identified patent and that said Letters Patent is hereby corrected as shown below:

Title page

Item (75) Inventors COUNTRY of Residence should read as follows:

Ken Clement, Milton, Ontario, CANADA;
Craig Clement, Kingston, Ontario, CANADA; and
John David Zikakis, Mount Albert, Ontario, CANADA Signed and Sealed this
Sixteenth Day of February, 2016

Michelle K. Lee

Michelle K. Lee
*Director of the United States Patent and Trademark Office*